US007323956B1

(12) United States Patent
Puskar et al.

(10) Patent No.: US 7,323,956 B1
(45) Date of Patent: Jan. 29, 2008

(54) ELECTRICAL SWITCHING APPARATUS AND TRIP UNIT INCLUDING ONE OR MORE FUSES

(75) Inventors: Michael P. Puskar, Carnegie, PA (US); William E. Beatty, Jr., Beaver, PA (US); Robert W. Mueller, Aliquippa, PA (US); Amelia M. Stay, Monaca, PA (US)

(73) Assignee: Eaton Corporation, Cleveland, OH (US)

( * ) Notice: Subject to any disclaimer, the term of this patent is extended or adjusted under 35 U.S.C. 154(b) by 200 days.

(21) Appl. No.: 11/194,081

(22) Filed: Jul. 29, 2005

(51) Int. Cl.
*H01H 75/12* (2006.01)

(52) U.S. Cl. ..... 335/6; 335/23; 335/35; 337/6; 337/7

(58) Field of Classification Search ..... 335/6–11, 335/21–23, 35–37, 43, 172; 337/6–7
See application file for complete search history.

(56) References Cited

U.S. PATENT DOCUMENTS

| | | | | |
|---|---|---|---|---|
| 2,949,516 | A * | 8/1960 | Edmunds | 337/6 |
| 3,118,991 | A * | 1/1964 | Scott, Jr. | 337/7 |
| 3,248,500 | A * | 4/1966 | Cellerini et al. | 337/7 |
| 3,280,280 | A * | 10/1966 | Gryctko | 337/6 |
| 3,287,521 | A * | 11/1966 | Gryctko et al. | 337/146 |
| 3,783,428 | A | 1/1974 | Swain et al. | |
| 4,660,009 | A | 4/1987 | Wafer et al. | |
| 4,766,408 | A | 8/1988 | Cameron et al. | |
| 5,319,344 | A | 6/1994 | Mosesian et al. | |
| 5,426,406 | A | 6/1995 | Morris et al. | |
| 5,587,570 | A | 12/1996 | Kelaita, Jr. et al. | |
| 5,835,002 | A | 11/1998 | Barnett | |
| 5,886,613 | A | 3/1999 | Magoon et al. | |
| 5,910,760 | A | 6/1999 | Malingowski et al. | |
| 6,137,386 | A | 10/2000 | Mueller | |
| 6,144,271 | A | 11/2000 | Mueller et al. | |
| 6,256,183 | B1 | 7/2001 | Mosesian | |
| 6,710,988 | B1 | 3/2004 | Yee et al. | |
| 6,850,135 | B1 | 2/2005 | Puskar et al. | |

* cited by examiner

*Primary Examiner*—Ramon M. Barrera
(74) *Attorney, Agent, or Firm*—Martin J. Moran

(57) ABSTRACT

A circuit breaker includes a circuit breaker frame and a trip unit. The circuit breaker frame includes a housing, a line terminal, a load terminal, separable contacts electrically connected between the line terminal and the load terminal, an operating mechanism structured to open and close the separable contacts, and a latch cooperating with the operating mechanism to open the separable contacts when actuated. The trip unit includes a housing, a line end terminal electrically connected to the load terminal of the circuit breaker frame, a load end terminal, and a fuse including a plunger. The fuse is housed by the housing of the trip unit and is electrically connected between the line end terminal and the load end terminal. An interface mechanism is structured to actuate the latch of the circuit breaker frame when the interface mechanism is engaged by the plunger of the fuse.

20 Claims, 3 Drawing Sheets

ELECTRICAL SWITCHING APPARATUS AND TRIP UNIT INCLUDING ONE OR MORE FUSES

BACKGROUND OF THE INVENTION

1. Field of the Invention

This invention relates to electrical switching apparatus and, more particularly, to circuit breakers employing a trip unit. The invention also relates to circuit breaker trip units.

2. Background Information

Circuit breakers and circuit breaker trip units are well known in the art. See, for example, U.S. Pat. Nos. 5,910,760; 6,144,271; and 6,850,135.

As disclosed in U.S. Pat. No. 6,144,271, a plunger of a trip unit is employed to trip open an associated circuit breaker frame whenever the plunger is extended from the trip unit. Actuation of primary and secondary frame latches occurs exclusively by way of the extended and resettable trip unit plunger, which is, otherwise, normally contained entirely within the trip unit. The secondary frame latch is in disposition to be struck by an abutment surface of the extended plunger. In response to a reset operation, the trip unit is also reset whenever the secondary frame latch drives the extended plunger in the opposite direction against its plunger spring and into the trip unit.

It is known to provide a fuse having an indicator or plunger for indicating a triggered or open fuse condition. See, for example, U.S. Pat. Nos. 3,783,428; 4,766,408; 5,319,344; 5,886,613; and 6,256,183.

U.S. Pat. No. 5,426,406 discloses a molded case circuit breaker unit including an accessory compartment within the circuit breaker cover. A field-replaceable fuse is contained within the compartment for protecting an electric motor without tripping upon motor current reversal. An electronic trip unit within the circuit breaker is adjusted for short time over-current protection, while the fuse is selected to protect against short circuits. The fuse can optionally be installed within the circuit breaker accessory enclosure or in a separate compartment attached to the circuit breaker housing. Upon the occurrence of a short circuit within the protected circuit, the fuse operates to isolate the protected equipment and is conveniently replaced without disassembling the circuit breaker components.

U.S. Pat. No. 5,587,570 discloses a molded case circuit breaker including a fuse enclosure and an interlock unit. Upon the occurrence of a short circuit, one or more indicating fuses operate to isolate the protected equipment. Interference between a tab of the interlock unit and the indicators of the fuses prevents the operating handle from being moved to a reset position to turn the circuit breaker on. When the fuses are replaced, the normal positions of the indicators allow the movement of the operating handle from the tripped position to the reset position.

U.S. Pat. No. 5,835,002 discloses an interlock assembly for use in a manually operated multi-phase fusible switch having a fuse in series with a blade for each phase and a handle for simultaneously controlling the position of the blades.

U.S. Pat. No. 6,710,988 discloses a molded case electric switch housing including an electric switch control circuit for motor overload and phase loss conditions, a motor contactor control circuit for turning an associated electric motor on and off, and a replaceable fuse unit for handling short-circuit type faults.

There is a need for an improved electrical switching apparatus employing a trip unit.

There is also a need for an improved trip unit.

SUMMARY OF THE INVENTION

These needs and others are met by the present invention, which provides a trip unit including a fuse having a plunger and an interface mechanism structured to actuate a latch of a circuit breaker frame when the interface mechanism is engaged by the plunger of the fuse.

In accordance with one aspect of the invention, an electrical switching apparatus comprises: a circuit breaker frame comprising: a housing, a line terminal, a load terminal, separable contacts electrically connected between the line terminal and the load terminal, an operating mechanism structured to open and close the separable contacts, and a latch cooperating with the operating mechanism to open the separable contacts when actuated; and a trip unit comprising: a housing, a line end terminal electrically connected to the load terminal of the circuit breaker frame, a load end terminal, a fuse including a plunger, the fuse being housed by the housing of the trip unit and being electrically connected between the line end terminal and the load end terminal, and an interface mechanism structured to actuate the latch of the circuit breaker frame when the interface mechanism is engaged by the plunger of the fuse.

The line end terminal of the trip unit may be electrically connected to the load terminal of the circuit breaker frame by a fastener which is accessible external to the housing of the circuit breaker frame and the housing of the trip unit. The housing of the circuit breaker frame may include an opening structured to receive the housing of the trip unit, in order that the trip unit is field mountable, field replaceable or interchangeable with another trip unit.

The interface mechanism of the trip unit may comprise a pivotally mounted trip bar including a tab structured to be engaged by the plunger of the fuse.

As another aspect of the invention, a circuit breaker comprises: a circuit breaker frame comprising: a housing, at least one pole comprising: a line terminal, a load terminal, and separable contacts electrically connected between the line terminal and the load terminal, an operating mechanism structured to open and close the separable contacts, and a latch cooperating with the operating mechanism to open the separable contacts when actuated; and a trip unit comprising: a housing, at least one pole comprising: a line end terminal electrically connected to a corresponding load terminal of the circuit breaker frame, a load end terminal, and a fuse including a plunger, the fuse being housed by the housing of the trip unit and being electrically connected between the line end terminal and the load end terminal, and an interface mechanism structured to actuate the latch of the circuit breaker frame after the interface mechanism is engaged by the plunger of the fuse.

The interface mechanism of the trip unit may comprise a pivotally mounted trip bar including a tab structured to be engaged by the plunger of the fuse.

As another aspect of the invention, a trip unit for a circuit breaker frame including a latch and a load terminal comprises: a housing; a first terminal structured to be electrically connected to the load terminal of the circuit breaker frame; a second terminal; at least one fuse including a plunger, the at least one fuse being housed by the housing and being electrically connected between the first terminal and the second terminal; and an interface mechanism structured to actuate the latch of the circuit breaker frame when the interface mechanism is engaged by the plunger of the at least one fuse.

The interface mechanism may comprise a pivotally mounted trip bar including a tab structured to be engaged by the plunger of the at least one fuse.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is described in association with a circuit breaker trip unit, although the invention is applicable to a wide range of electrical switching apparatus. Examples of trip units are disclosed in U.S. Pat. Nos. 6,144,271; and 6,850,135, which are incorporated herein by reference.

Figure 1:
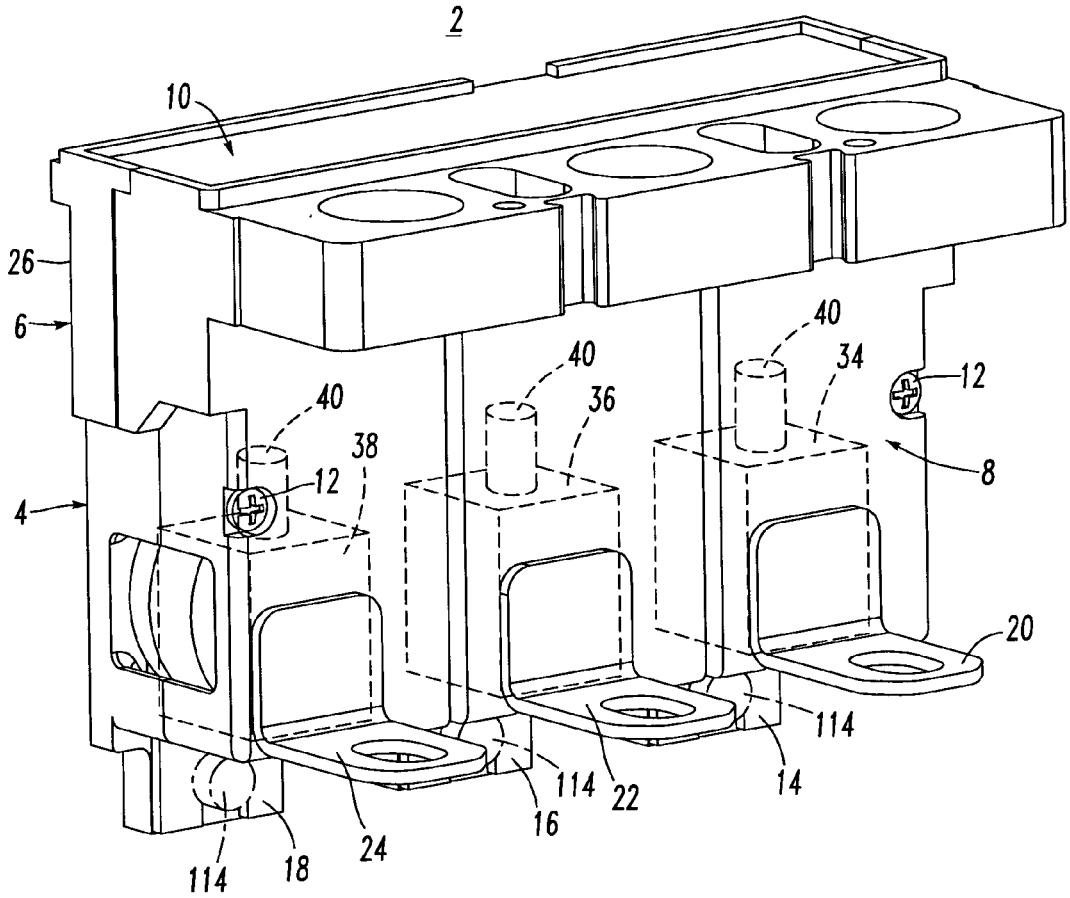
FIG. 1 is a front isometric view of a trip unit in accordance with the present invention.
Figure 2:
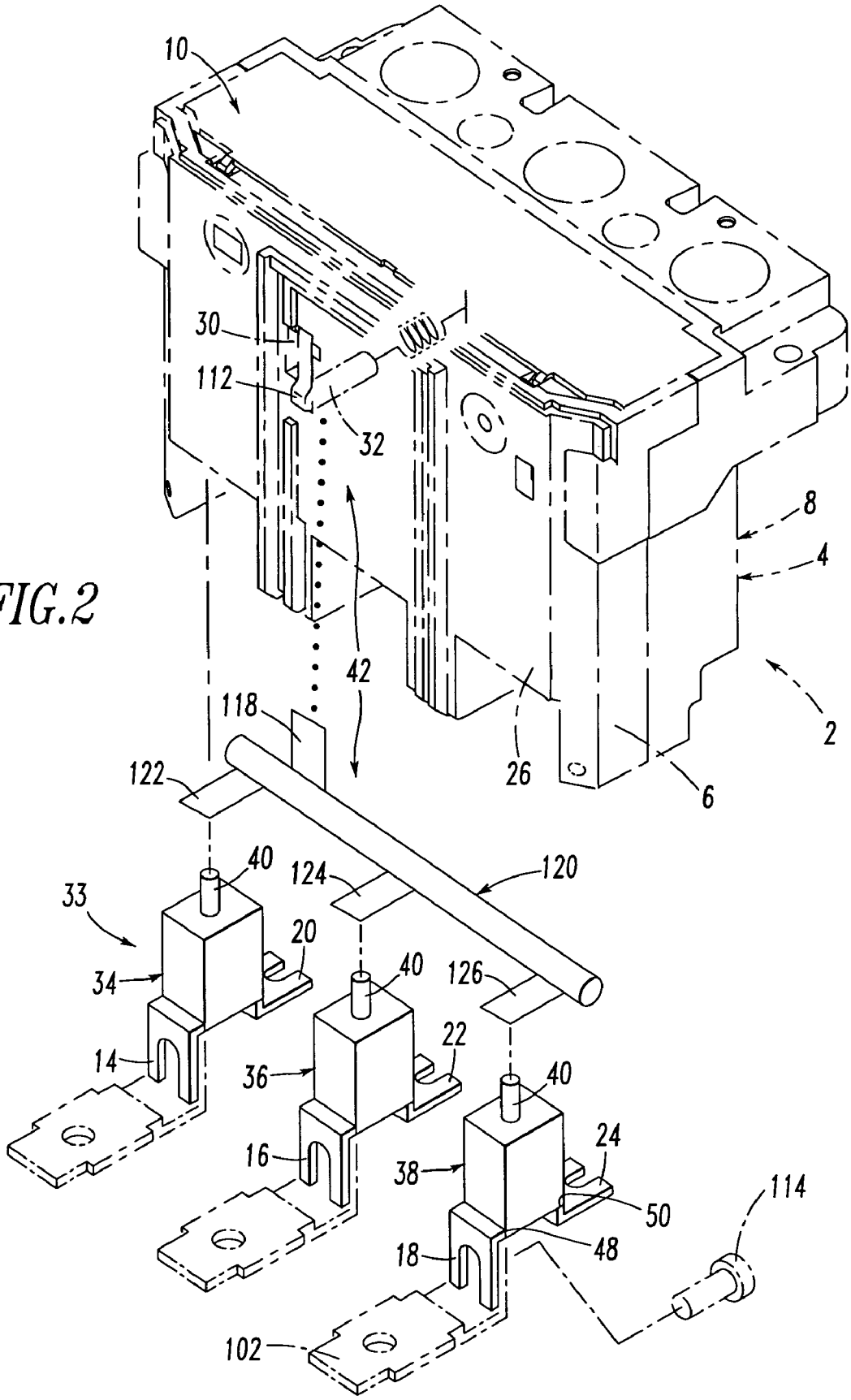
FIG. 2 is a rear isometric view of the trip unit of FIG. 1 showing the fuses, trip bar, spring-biased plunger, and line and load end terminals.
Figure 3:
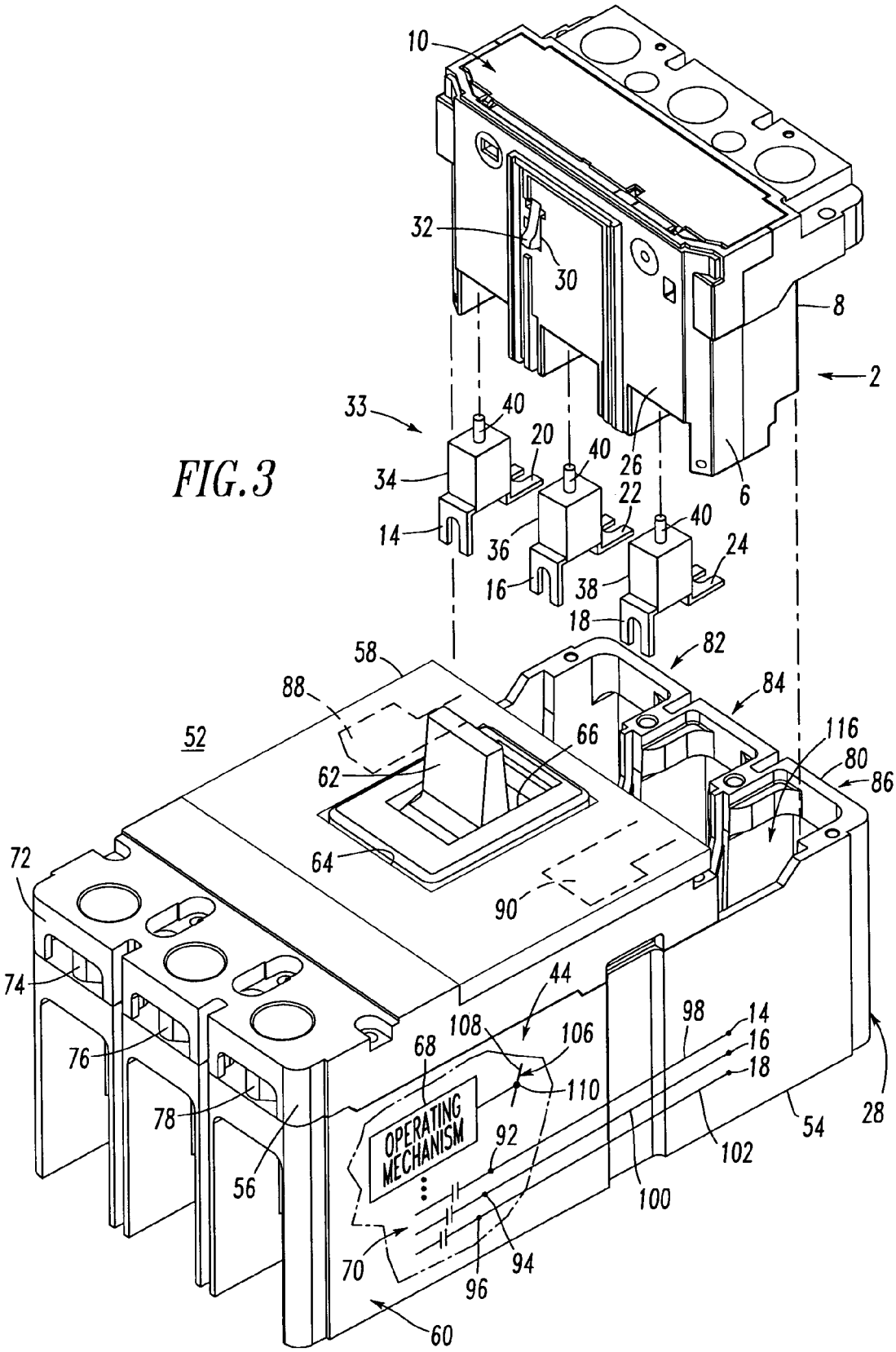
FIG. 3 is an isometric view of a circuit breaker including the trip unit of FIG. 1.

Referring to FIGS. 1 and 2, a trip unit 2 is shown. The trip unit 2 includes a molded housing 4 having a base 6, a cover 8 and a top portion 10. A pair of screws 12 secures the cover 8 to the base 6. Disposed from the base 6 are three-phase line end terminals 14,16,18; the cover 8 includes corresponding load end terminals 20,22,24, respectively. The base 6 includes a surface 26 (as best shown in FIG. 2), which is disposed within a circuit breaker frame 28 (shown in FIG. 3). The trip unit 2 is advantageously adapted for engagement within and disengagement from the circuit breaker frame 28. The base surface 26 includes an opening 30 for a plunger 32, which includes a first or on position (FIG. 2) and a second or tripped position (FIG. 3). The on position is substantially flush with the base surface 26, and the tripped position is extended from that surface 26.

As shown in FIG. 2, in accordance with an important aspect of the invention, the trip unit 2 includes one or more fuses 33 (three fuses 34,36,38 are shown in the example of FIG. 2). Each of the fuses 33 includes a plunger 40, which is structured to extend or "pop out" from the corresponding fuse after it is blown or opened in response to a short circuit or other over current condition. An interface mechanism 42 is structured to actuate a latch 44 (shown in FIG. 3) of the circuit breaker frame 28 (shown in FIG. 3) when (e.g., after) the interface mechanism 42 is engaged by one or more of the fuse plungers 40. The fuses 34,36,38 are housed by the trip unit housing 4 and are electrically connected between the line end terminals 14,16,18 and the load end terminals 34,36,38, respectively.

For example, as shown with the fuse 38, each of the fuses 33 includes two terminals 48 and 50 that correspond to the line end terminal 18 and the load end terminal 24 of one phase of the trip unit 2. Those fuse terminals 48,50 carry the load current that passes between and through the terminals 18,24. Although an example arrangement of terminals 18,48, 50,24 is shown to form one pole of the trip unit 2, a wide range of other terminal configurations within the trip unit 2 having one or more poles are possible.

FIG. 3 shows a molded case circuit interrupter, such as circuit breaker 52, including the circuit breaker frame 28 and the removable trip unit 2 of FIG. 1. Examples of circuit breakers and circuit breaker frames are disclosed in U.S. Pat. Nos. 5,910,760; 6,137,386; and 6,144,271, which are incorporated by reference herein. The example circuit breaker 52 includes a main base 54 and primary cover 56 attached to a secondary cover 58. The base 54 and covers 56,58 form a housing 60. A handle 62 extends through a secondary escutcheon 64 in the secondary cover 58 and an aligned primary escutcheon 66 in the primary cover 56. The operating mechanism 68 is interconnected with the handle 62 and assists in opening and closing separable main contacts 70 as is well known. The circuit breaker 52 has a line end 72 including a plurality of line terminals 74,76,78, a load end 80 including a plurality of load terminals 82,84,86, a first accessory region or pocket 88 and a second accessory pocket or region 90. The separable contacts 70 are electrically connected between the line terminals 74,76,78 and a plurality of load end terminals 92,94,96.

The load end terminals 92,94,96 of the circuit breaker frame 28 are electrically connected to the line end terminals 14,16,18 (as best shown in FIGS. 1 and 2) of the trip unit 2 by a plurality of conductors 98,100,102, respectively. The load end terminals 20,22,24 of the trip unit 2 are electrically connected by suitable user installed terminations (not shown) to the load terminals 82,84,86, respectively, of the circuit breaker frame 28.

A latch mechanism 106 latches the operating mechanism 68 to provide the closed position of the separable contacts 70 and releases such operating mechanism to provide the tripped open position of such separable contacts. The latch mechanism 106 includes a primary frame latch (not shown), which operates or rotates on a primary frame latch pivot (not shown). The primary frame latch cooperates with the secondary frame latch 108, which rotates on a secondary frame latch pivot 110. Actuation of the latch mechanism 106 occurs by way of the utilization of the trip unit plunger 32, which is normally contained entirely within the removable trip unit 2 (as shown in FIG. 2). In particular, the pivotable secondary frame latch 108 is in disposition to be pivoted by the plunger surface 112 (FIG. 2) through the movement thereof when the plunger 32 is extended (as shown in FIG. 3). Hence, the plunger 32 of the interface mechanism 42 (FIG. 2) is structured to actuate the secondary frame latch 108 when (e.g., after) the interface mechanism 42 is engaged by one or more of the fuse plungers 40 (FIG. 2).

The trip unit line end terminals 14,16,18 are electrically connected to the load end terminals 92,94,96 of the circuit breaker frame 28 (FIG. 3) by suitable fasteners 114 (as shown with the terminal 18 and conductor 102 (shown in phantom line drawing) of FIG. 2) which fasteners are accessible external to the housing 60 of the circuit breaker frame 28 and the housing 4 of the trip unit 2.

The circuit breaker frame housing 60 includes an opening 116 structured to receive the trip unit housing 4, in order that the trip unit 2 is field mountable, field replaceable or interchangeable with another identical or similar trip unit (not shown) (e.g., a trip unit having a different current rating).

EXAMPLE 1

In this example, each trip unit pole or phase has its own fuse. Hence, for the example three-phase trip unit 2 and the three-phase circuit breaker frame 28 of FIG. 3, there are three fuses 34,36,38 (FIG. 2) for the three phases. Also, in this example, a pivotally mounted trip unit trip bar 120 of the interface mechanism 42 includes three tabs 122,124,126 for engagement by one, two or all of the three fuse plungers 40 whenever they are extended. Although a three-phase circuit breaker 52 is shown, the invention is applicable to trip units, circuit breaker frames and circuit breakers having one or more phases.

EXAMPLE 2

During a relatively high fault condition, the corresponding one of the fuses 33 clears the fault (e.g., up to a suitable current and voltage rating; up to about 200 kA at about 600 VAC) for the corresponding phase. The maximum current rating of the fused trip unit 2 is limited by the thermal capacity of the circuit breaker operating mechanism 68 of the corresponding circuit breaker frame 28.

EXAMPLE 3

The trip unit 2 may contain a wide range of different amperage-rated fuses 33. Hence, this permits the trip unit 2 and the corresponding circuit breaker frame 28 to cover a wide range of current ratings.

EXAMPLE 4

The example trip unit 2 is also highly effective in a direct current power circuit (not shown).

EXAMPLE 5

Actuation of the latch mechanism 106 of the circuit breaker frame 28 of FIG. 3 occurs by way of the utilization of the trip unit trip plunger 32, which is normally contained entirely within the removable trip unit 2 of FIG. 2. The trip unit trip plunger 32 is controlled or latched by way of a plunger latch or interference latch 118 of the trip bar 120. The secondary frame latch 108 (FIG. 3) of the circuit breaker frame 28 is in disposition to be struck by the moving trip unit plunger abutment surface 112.

EXAMPLE 6

The trip unit interface mechanism 42 includes the pivotally mounted (e.g., within an inner surface recess of the cover 6) trip bar 120 having a first tab 122 structured to be engaged by the plunger 40 of the fuse 34 and a second member, such as the plunger latch or interference latch 118, which forms a second tab. The spring-biased plunger 32 is structured to pass through the opening 30 of the trip unit housing 4, in order to actuate the latch mechanism 106 of the circuit breaker frame 28 when the interface mechanism 42 is engaged by the plunger 40. The trip bar second tab 118 normally engages and holds the spring-biased plunger 32 within the opening 30. The second tab 118 releases the spring-biased plunger 32 in order to actuate the circuit breaker frame secondary latch 108 when (e.g., after) the plunger 40 engages the first tab 122, pivots the trip bar 120 and, thus, trips the trip unit 2. The trip unit spring-biased plunger 32 is held by the trip bar 120 until the trip bar is sufficiently rotated out of the way. In turn, the trip bar 120 releases the spring-biased plunger 32, which extends as shown in FIG. 3 to trip the circuit breaker frame 28.

It will be appreciated that the plungers 40 of the fuses 36,38 cooperate with the tabs 124,126, respectively, of the trip bar 120 in a similar manner as was described above in connection with the first tab 122.

EXAMPLE 7

Alternatively, any suitable trip bar and plunger may be employed, such as, for example, the pivotally mounted trip bar, rotary plunger and rotary trip lever of U.S. Pat. No. 6,850,135, which latches the plunger in an on position and releases the plunger to a tripped position.

EXAMPLE 8

The fuses 33 are housed by the sealed, molded trip unit housing 4 of FIG. 2. The trip unit 2 is replaceable in the field as shown in FIG. 3. The exterior of the housing 4 preferably looks at least substantially identical to the housing (not shown) of a conventional electronic and thermal-magnetic trip unit (not shown) for a conventional circuit breaker frame (e.g., frame 28). However, the interior of the example trip unit 2 contains the fuses 33. The trip unit housing 4 substantially encloses the fuses 33.

EXAMPLE 9

The fuses 33 incorporated in the example trip unit 2 increase the interruption capacity of the circuit breaker frame 28. The advantage of the trip unit 2 is increased interruption performance in the same size platform. After one or more of the fuses 33 open, the trip unit 2 needs to be replaced before the circuit breaker 52 (FIG. 3) can be returned to service.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a circuit breaker frame comprising:

a housing, a line terminal, a load terminal, separable contacts electrically connected between said line terminal and said load terminal, an operating mechanism structured to open and close said separable contacts, and a latch cooperating with said operating mechanism to open said separable contacts when actuated; and a trip unit comprising:

a housing, a line end terminal electrically connected to the load terminal of said circuit breaker frame, a load end terminal, a fuse including a plunger, said fuse being housed by the housing of said trip unit and being electrically connected between said line end terminal and said load end terminal, and an interface mechanism structured to actuate the latch of said circuit breaker frame when said interface mechanism is engaged by the plunger of said fuse, wherein the housing of said circuit breaker frame includes an opening structured to receive the housing of said trip unit, and wherein the line end terminal of said trip unit is electrically and mechanically connected to the load terminal of said circuit breaker frame by a fastener which is accessible external to the housing of said circuit breaker frame and the housing of said trip unit when the opening of said circuit breaker frame receives the housing of said trip unit in order that said trip unit which houses said fuse is field mountable or field replaceable.

2. The electrical switching apparatus of claim 1 wherein said trip unit is interchangeable with another trip unit.

3. The electrical switching apparatus of claim 1 wherein the housing of said trip unit substantially encloses said fuse.

4. The electrical switching apparatus of claim 1 wherein the interface mechanism of said trip unit comprises a pivotally mounted trip bar including a tab structured to be engaged by the plunger of said fuse.

5. The electrical switching apparatus of claim 4 wherein the housing of said trip unit includes an opening; wherein the tab of said pivotally mounted trip bar is a first tab; wherein said pivotally mounted trip bar further includes a second tab; and wherein the interface mechanism of said trip unit further comprises a spring-biased plunger structured to pass through the opening of the housing of said trip unit, the second tab of said trip bar normally engaging and holding said spring-biased plunger within the opening of the housing of said trip unit, the second tab of said trip bar releasing said spring-biased plunger in order to actuate the latch of said circuit breaker frame when the plunger of said fuse engages the first tab of said pivotally mounted trip bar and pivots said pivotally mounted trip bar.

6. The electrical switching apparatus of claim 1 wherein the housing of said trip unit includes an opening; and wherein the interface mechanism of said trip unit further comprises a spring-biased plunger structured to pass through the opening of the housing of said trip unit, in order to actuate the latch of said circuit breaker frame when said interface mechanism is engaged by the plunger of said fuse.

7. The electrical switching apparatus of claim 6 wherein the interface mechanism of said trip unit further comprises a member structured to engage and hold said spring-biased plunger within the opening of the housing of said trip unit until after the plunger of said fuse engages said interface mechanism.

8. The electrical switching apparatus of claim 1 wherein the latch of said circuit breaker frame is a secondary frame latch; and wherein the interface mechanism comprises a plunger structured to actuate the secondary frame latch of said circuit breaker frame after said interface mechanism is engaged by the plunger of said fuse.

9. The electrical switching apparatus of claim 1 wherein said fuse includes first and second terminals; wherein the line end terminal of said trip unit is directly electrically connected to the first terminal of said fuse; and wherein the load end terminal of said trip unit is directly electrically connected to the second terminal of said fuse.

10. A circuit breaker comprising:

a circuit breaker frame comprising:

a housing, at least one pole comprising:

a line terminal, a load terminal, and separable contacts electrically connected between said line terminal and said load terminal, an operating mechanism structured to open and close said separable contacts, and a latch cooperating with said operating mechanism to open said separable contacts when actuated; and a trip unit comprising:

a housing, at least one pole comprising:

a line end terminal electrically connected to a corresponding load terminal of said circuit breaker frame, a load end terminal, and a fuse including a plunger, said fuse being housed by the housing of said trip unit and being electrically connected between said line end terminal and said load end terminal, and an interface mechanism structured to actuate the latch of said circuit breaker frame after said interface mechanism is engaged by the plunger of said fuse, wherein the housing of said circuit breaker frame includes an opening structured to receive the housing of said trip unit, and wherein the line end terminal of said trip unit is electrically and mechanically connected to the load terminal of said circuit breaker frame by a fastener which is accessible external to the housing of said circuit breaker frame and the housing of said trip unit when the opening of said circuit breaker frame receives the housing of said trip unit in order that said trip unit which houses said fuse is field mountable or field replaceable.

11. The circuit breaker of claim 10 wherein the interface mechanism of said trip unit comprises a pivotally mounted trip bar including a tab structured to be engaged by the plunger of said fuse.

12. The circuit breaker of claim 11 wherein the housing of said trip unit includes an opening; wherein the tab of said pivotally mounted trip bar is a first tab; wherein said pivotally mounted trip bar further includes a second tab; and wherein the interface mechanism of said trip unit further comprises a spring-biased plunger structured to pass through the opening of the housing of said trip unit, the second tab of said trip bar normally engaging and holding said spring-biased plunger within the opening of the housing of said trip unit, the second tab of said trip bar releasing said spring-biased plunger in order to actuate the latch of said circuit breaker frame after the plunger of said fuse engages the first tab of said pivotally mounted trip bar and pivots said pivotally mounted trip bar.

13. The circuit breaker of claim 10 wherein the housing of said trip unit includes an opening; and wherein the interface mechanism of said trip unit further comprises a spring-biased plunger structured to pass through the opening of the housing of said trip unit, in order to actuate the latch of said circuit breaker frame after said interface mechanism is engaged by the plunger of said fuse.

14. The circuit breaker of claim 10 wherein the latch of said circuit breaker frame is a secondary frame latch; and wherein the interface mechanism comprises a plunger structured to actuate the secondary frame latch of said circuit breaker frame after said interface mechanism is engaged by the plunger of said fuse.

15. A trip unit for a circuit breaker frame including a housing having an opening, a latch and a load terminal, said trip unit comprising:

a housing;

a first terminal structured to be electrically connected to the load terminal of said circuit breaker frame;

a second terminal;

at least one fuse including a plunger, said at least one fuse being housed by said housing and being electrically connected between said first terminal and said second terminal; and an interface mechanism structured to actuate the latch of said circuit breaker frame when said interface mechanism is engaged by the plunger of said at least one fuse, wherein the housing of said trip unit is structured to be received by the opening of the housing of said circuit breaker frame, and wherein the line end terminal of said trip unit is structured to be electrically and mechanically connected to the load terminal of said circuit breaker frame by a fastener which is accessible external to the housing of said circuit breaker frame and the housing of said trip unit when the housing of said trip unit is received by the opening of the housing of said circuit breaker frame in order that said trip unit which houses said fuse is field mountable or field replaceable.

16. The trip unit of claim 15 wherein said interface mechanism comprises a pivotally mounted trip bar including a tab structured to be engaged by the plunger of said at least one fuse.

17. The trip unit of claim 16 wherein said housing includes an opening; wherein the tab of said pivotally mounted trip bar is a first tab; wherein said pivotally mounted trip bar further includes a second tab; and wherein said interface mechanism further comprises a spring-biased plunger structured to pass through the opening of said housing, the second tab of said trip bar normally engaging and holding said spring-biased plunger within the opening of said housing, the second tab of said trip bar releasing said spring-biased plunger in order to actuate the latch of said circuit breaker frame when the plunger of said at least one fuse engages the first tab of said pivotally mounted trip bar and pivots said pivotally mounted trip bar.

18. The trip unit of claim 15 wherein said housing includes an opening; and wherein said interface mechanism further comprises a spring-biased plunger structured to pass through the opening of said housing, in order to actuate the latch of said circuit breaker frame when said interface mechanism is engaged by the plunger of said at least one fuse.

19. The trip unit of claim 15 wherein the latch of said circuit breaker frame is a secondary frame latch; and wherein said interface mechanism comprises a plunger structured to actuate the secondary frame latch of said circuit breaker frame after said interface mechanism is engaged by the plunger of said at least one fuse.

20. The trip unit of claim 15 wherein said circuit breaker frame includes three poles; and wherein said at least one fuse is three fuses.

* * * * *